US010458164B2

(12) United States Patent
Wantland et al.

(10) Patent No.: US 10,458,164 B2
(45) Date of Patent: Oct. 29, 2019

(54) DOOR HINGE ASSEMBLY FOR AN APPLIANCE

(71) Applicant: Haier US Appliance Solutions, Inc., Wilmington, DE (US)

(72) Inventors: Louis A. Wantland, Louisville, KY (US); Bagawathkumar Chellappan, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 56 days.

(21) Appl. No.: 15/706,878

(22) Filed: Sep. 18, 2017

(65) Prior Publication Data

US 2019/0085607 A1 Mar. 21, 2019

(51) Int. Cl.

| | |
|---|---|
| ***E05D 7/04*** | (2006.01) |
| ***F25D 23/02*** | (2006.01) |
| ***E05F 1/04*** | (2006.01) |
| ***E05D 7/081*** | (2006.01) |

(52) U.S. Cl.

CPC ..... *E05D 7/04* (2013.01); *E05D 7/081* (2013.01); *E05F 1/043* (2013.01); *F25D 23/028* (2013.01); *E05Y 2201/638* (2013.01); *E05Y 2900/31* (2013.01); *F25D 2323/024* (2013.01)

(58) Field of Classification Search

CPC . E05D 7/04; E05D 7/081; E05F 1/043; F25D 23/028; F25D 2323/024; E05Y 2201/638; E05Y 2900/31

See application file for complete search history.

(56) References Cited

U.S. PATENT DOCUMENTS

| | | | | |
|---|---|---|---|---|
| 5,272,789 | A | 12/1993 | Mitchell et al. | |
| 5,522,656 | A | 6/1996 | Jenkins | |
| 6,845,545 | B2 * | 1/2005 | Han | E05F 1/1269 16/277 |
| 7,111,363 | B2 * | 9/2006 | Lee | E05D 11/1078 16/295 |
| 8,510,913 | B2 * | 8/2013 | Kim | E05D 11/06 16/268 |
| 10,260,261 | B2 * | 4/2019 | Reuter | E05D 7/0415 |
| 2005/0262663 | A1 * | 12/2005 | Lee | E05D 5/121 16/221 |
| 2012/0096734 | A1 * | 4/2012 | Moon | D06F 58/10 34/218 |
| 2013/0026900 | A1 * | 1/2013 | Oh | F25D 23/02 312/401 |

(Continued)

FOREIGN PATENT DOCUMENTS

CN 101504240 B 10/2012

*Primary Examiner* — Hanh V Tran
(74) *Attorney, Agent, or Firm* — Dority & Manning, P.A.

(57) ABSTRACT

A hinge assembly for an appliance includes features that allow for a door rotatably hinged to the appliance to be raised or lowered through various phases of the swing arc of the door by utilizing a ramped surface of a bracket of the hinge assembly as the working surface. In one exemplary aspect, a hinge assembly includes a hinge bracket having a pivot pin and a ramped surface. The door hinge assembly also includes a cam assembly coupled with the door and having a cam projection. As the door is swung about its swing arc, the cam projection engages the ramped surface of the hinge bracket. In this way, the door can be raised along the vertical direction as the door is rotated through its swing arc.

20 Claims, 8 Drawing Sheets

(56) References Cited

U.S. PATENT DOCUMENTS

| | | | | |
|---|---|---|---|---|
| 2013/0154464 | A1* | 6/2013 | Fiori | E05D 7/0423 312/405 |
| 2014/0132144 | A1* | 5/2014 | Kim | F25D 23/028 312/405 |
| 2014/0259529 | A1* | 9/2014 | Jenkinson | E05D 7/0027 16/248 |
| 2014/0306595 | A1* | 10/2014 | Hwang | F25D 23/028 312/404 |
| 2015/0059126 | A1* | 3/2015 | Dubina | E05D 7/00 16/319 |
| 2015/0233629 | A1* | 8/2015 | Choi | F25D 23/04 312/404 |
| 2015/0260443 | A1* | 9/2015 | Lee | F25D 23/02 312/404 |
| 2016/0084560 | A1* | 3/2016 | Jeong | F25D 11/02 62/344 |
| 2016/0123654 | A1* | 5/2016 | Lee | E05D 5/02 312/404 |
| 2017/0167173 | A1* | 6/2017 | Johnson | E05D 11/0081 |
| 2018/0149409 | A1* | 5/2018 | Ramm | E05D 7/081 |
| 2018/0156529 | A1* | 6/2018 | Wantland | F25D 23/025 |
| 2018/0187952 | A1* | 7/2018 | Lv | F25D 23/025 |
| 2018/0334844 | A1* | 11/2018 | Eom | E05F 15/611 |
| 2018/0335246 | A1* | 11/2018 | Jeong | F25D 23/025 |

* cited by examiner

DOOR HINGE ASSEMBLY FOR AN APPLIANCE

FIELD

The subject matter of the present disclosure relates generally to consumer appliances, e.g., refrigerator appliances, and more particularly to door hinge assemblies for consumer appliances.

BACKGROUND

Refrigerator appliances generally include a housing that defines one or more chilled chambers for receipt of food items for storage. One or more doors are provided for selectively accessing the chilled food storage chambers. Certain doors are rotatably hinged to the cabinet or another component of the refrigerator appliance, such as an inner door of a door having a door-in-door configuration.

Certain conventional refrigerator appliances include a hinge assembly to rotatably couple the door with the housing. Such hinge assemblies can include a cam riser that raises or lowers the door as the door rotates through its swing arc in order to facilitate either opening or closing of the door. Such cam risers typically have two or more opposing cam surfaces projecting along the vertical direction in line with a hinge axis of the hinge assembly. For applications where vertical space is limited, such as e.g., a refrigerator appliance having a refrigerator door with a nested or door-in-door configuration, such vertically oriented cam risers present design challenges. For instance, due to the vertically oriented design of such conventional cam risers, additional vertical space is typically required to rotatably couple the doors of the door-in-door configuration to the cabinet. The additional vertical space can be unsightly, can increase the amount of materials needed for constructing the refrigerator appliance, and can be impractical for smaller appliances designed for tight or limited spaces, such as e.g., a compact refrigerator appliance.

Accordingly, an improved door hinge assembly that addresses one or more of the above challenges would be useful.

BRIEF DESCRIPTION

The present subject matter provides a hinge assembly for an appliance that includes features that allow for a door rotatably hinged with the appliance to be raised or lowered through various phases of the swing arc of the door despite the minimal vertical span of the hinge assembly design. Additional aspects and advantages of the invention will be set forth in part in the following description, or may be apparent from the description, or may be learned through practice of the invention.

In a first exemplary embodiment, an appliance is provided. The appliance defines a vertical direction, a lateral direction, and a transverse direction. Each direction is mutually perpendicular. The appliance includes a housing and a door rotatable through a swing arc. The appliance also includes a hinge assembly rotatably coupling the door with the housing. The hinge assembly includes a hinge bracket coupled with the housing, the hinge bracket includes a ramped surface. The hinge assembly also includes a cam plate coupled or integral with the door, the cam plate having a cam projection projecting therefrom, wherein the cam projection engages the ramped surface as the door is rotated through at least a portion of the swing arc of the door such that the door is moved along the vertical direction.

In a second exemplary embodiment, a hinge assembly for a door of an appliance defining a vertical direction, a lateral direction, and a transverse direction is provided. The refrigerator appliance includes a housing. The door is rotatably coupled with the housing by the hinge assembly. The door is rotatable through a swing arc. The hinge assembly includes a hinge bracket coupled with the housing. The hinge bracket includes a ramped surface extending outward from the housing and sloped in the vertical direction as the ramped surface extends outward from the housing. The hinge bracket also includes a pin plate connected to the ramped surface of the hinge bracket. The hinge bracket further includes a pivot pin extending from the pin plate and defining a hinge axis. The hinge assembly also includes a cam assembly coupled or integral with the door. The cam assembly also includes a cam plate and a thimble extending from the cam plate along the hinge axis and configured to receive the pivot pin. The cam assembly further includes a cam projection projecting from the cam plate, wherein the cam projection engages the ramped surface as the door is rotated through at least a portion of the swing arc of the door such that the door is moved along the vertical direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
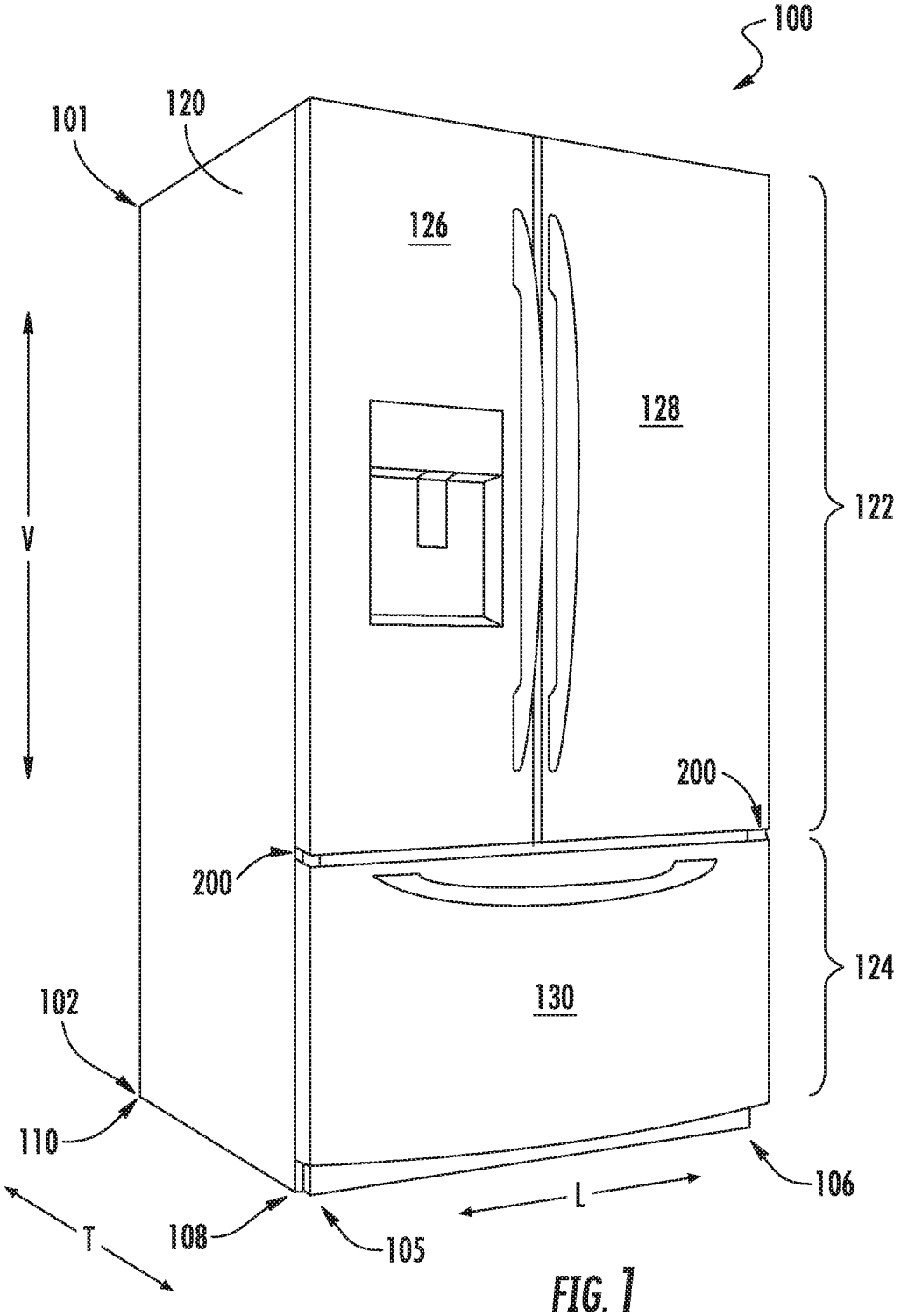
FIG. 1 provides a perspective view of a refrigerator appliance according to exemplary embodiments of the present disclosure with refrigerator doors and a freezer door shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. Terms such as "inner" and "outer" refer to relative directions with respect to the interior and exterior of the refrigerator appliance. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein. As used herein, terms of approximation, such as "generally," "substantially," or "about" are to be understood as including within ten percent greater or less than the stated amount or value. Further, such terms when used in the context of an angle or direction are to be understood as including within ten degrees greater or less than the stated angle or direction. For example, "generally perpendicular" is to be understood as encompassing angles ranging from eighty degrees to one hundred degrees.

Figure 2:
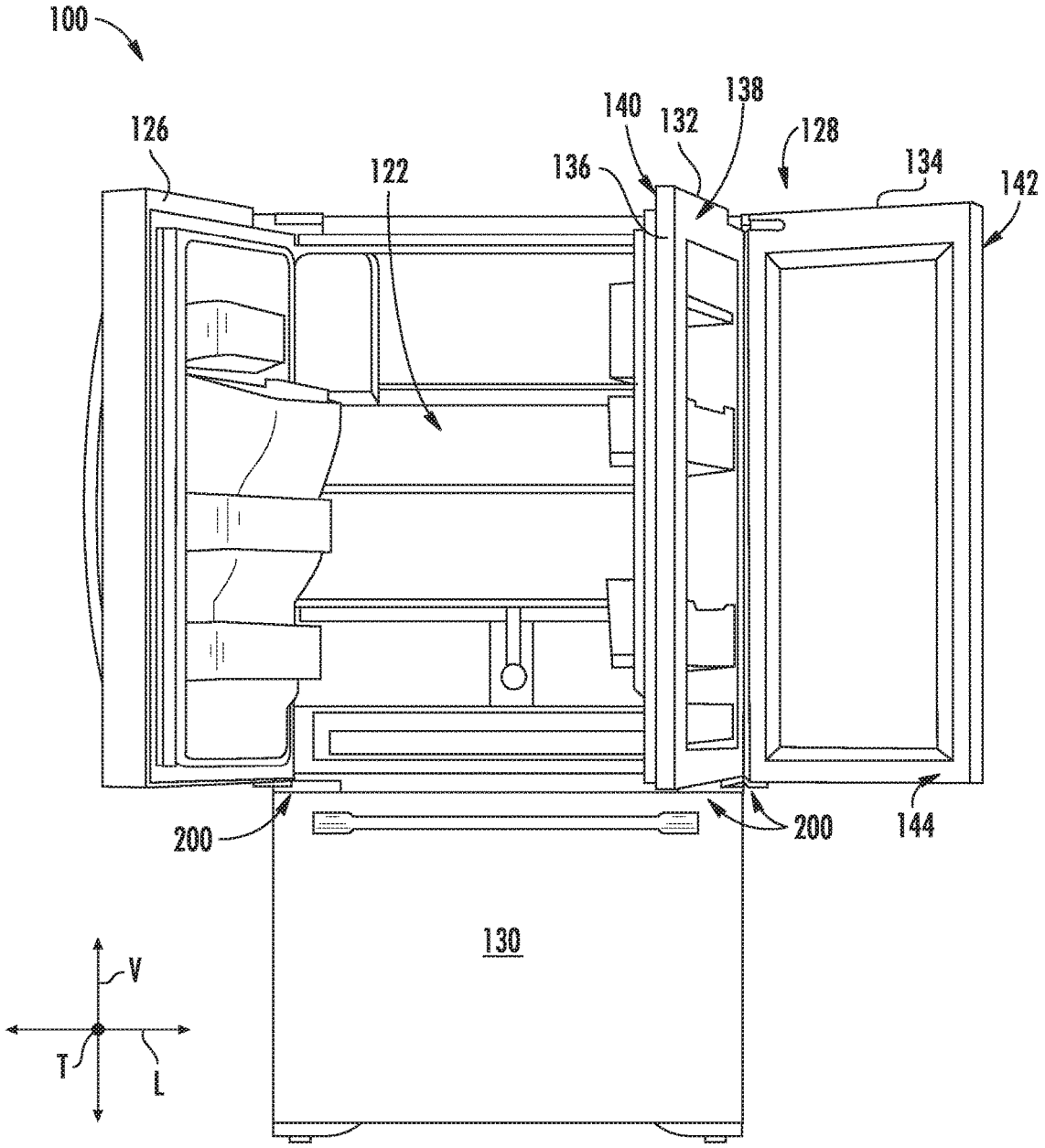
FIG. 2 provides a front elevation view of the refrigerator appliance of FIG. 1 with refrigerator doors shown in an open position.

FIG. 1 provides a perspective view of a refrigerator appliance 100 according to exemplary embodiments of the present subject matter. FIG. 2 provides a front elevation view thereof. As shown in FIG. 1, refrigerator appliance 100 includes a cabinet or housing 120 that extends between a top 101 and a bottom 102 along a vertical direction V. Housing 120 also extends between a first side 105 and a second side 106 along a lateral direction L and between a front 108 and a rear 110 along a transverse direction T. Vertical direction V, lateral direction L, and transverse direction T are mutually perpendicular and form an orthogonal direction system.

Housing 120 defines chilled chambers for receipt of food items for storage. In particular, housing 120 defines a fresh food chamber 122 positioned at or adjacent top 101 of housing 120 and a freezer chamber 124 arranged at or adjacent bottom 102 of housing 120. As such, refrigerator appliance 100 is generally referred to as a bottom mount refrigerator. It is recognized, however, that the benefits of the present disclosure matter apply to other types and styles of refrigerator appliances, such as e.g., top mount refrigerator appliances, side-by-side style refrigerator appliances, and wine storage refrigerators. Moreover, the benefits of the present disclosure matter may likewise apply to freezer appliances, e.g., upright freezers. In addition, the teachings of the present disclosure may also apply to other types of appliances, including e.g., microwaves, dryers, washing machines, etc. Consequently, the description set forth herein is for exemplary purposes only and is not intended to be limiting in any aspect to any particular type of consumer appliance.

For this embodiment, refrigerator doors 126, 128 are configured in a French door configuration and are rotatably hinged or mounted to an edge of housing 120 for selectively accessing fresh food chamber 122. Refrigerator door 126 (i.e., left door) is rotatably mounted or hinged to housing 120 at first side 105 of housing 120. In particular, for this embodiment, refrigerator door 126 is rotatably mounted to housing 120 via a hinge assembly 200. Refrigerator door 128 (i.e., right door) is rotatably mounted or hinged to housing 120 at second side 106 of housing 120. More specifically, refrigerator door 128 is rotatably mounted to housing 120 via hinge assembly 200. In FIG. 1, refrigerator doors 126, 128 are shown in a closed position. In FIG. 2, refrigerator doors 126, 128 are shown in an open position.

As shown in FIG. 2, refrigerator door 128 has a door-in-door configuration or nested door assembly. As such, refrigerator door 128 includes an inner door 132 and an outer door 134, both of which are shown in an open position in FIG. 2. In other embodiments, refrigerator door 126 can likewise have a door-in-door configuration or nested assembly. In this way, one or both of refrigerator doors 126, 128 can have door-in-door configurations.

Inner door 132 includes a frame 136 that has an outer surface 138 and an opposing inner surface 140 that faces toward fresh food chamber 122 when inner door 132 is in a closed position. Inner door 132 is rotatably hinged to housing 120, e.g., such that inner door 132 is movable between a closed position (FIG. 1) and an open position (FIG. 2) to permit selective access to fresh food chamber 122. In particular, inner door 132 can be rotatably coupled or mounted directly to housing 120 at the second side 105 of housing 120 via hinge assembly 200. Inner door 132 defines an opening extending through the outer and inner surfaces 138, 140 of frame 136 and into fresh food chamber 122. Frame 136 extends around a perimeter of the opening defined by inner door 132. Frame 136 can extend into the fresh food chamber 122 when inner door 132 is in the closed position.

Outer door 134 includes an outer surface 142 and an opposing inner surface 144. The outer surface 142 faces an exterior of refrigerator appliance 100 and inner surface 144 faces toward fresh food chamber 122 or toward the interior of refrigerator appliance 100 when outer door 134 is in the closed position. As shown, outer door 134 is rotatably coupled or hinged to inner door 132 via another or additional hinge assembly 200 (i.e., a separate hinge assembly 200 from hinge assembly 200 rotatably coupling inner door 132 with housing 120). In this way, outer door 134 is directly rotatably coupled with inner door 132 and indirectly rotatably coupled with housing 120 of refrigerator appliance 100. Outer door 134 is movable between a closed position (FIG. 1) and an open position (FIG. 2). In some embodiments, outer door 134 is movable to permit selective access to a portion of fresh food chamber 122 through the opening defined by inner door 132. When in a closed position, a portion of outer door 134 can be received within frame 136 of inner door 132.

Inner and outer doors 132, 134 can generally move in the same direction. Specifically, inner and outer doors 132, 134 can each move away or swing out from fresh food chamber 122 of refrigerator appliance 100 when moving toward their respective open positions or the fully open position. Moreover, inner and outer doors 132, 134 can each move toward fresh food chamber 122 of refrigerator appliance 100 when moving toward their respective closed positions.

In some embodiments, refrigerator appliance 100 includes a gasket positioned on inner surface 144 of outer door 134. As outer door 134 moves toward the closed position, outer door 134 can compress the gasket against outer surface 138 of inner door 132. Specifically, the gasket may seal against outer surface 138 of inner door 132 to enclose fresh food chamber 122. In alternative embodiments, the gasket can be positioned on outer surface 138 of inner door 132, and as outer door 134 moves toward the closed position, inner door 132 can compress the gasket against inner surface 144 of outer door 134. More specifically, the gasket can seal against inner surface 144 of outer door 134. It should be appreciated that the gasket can be formed of any suitable material. For example, in some embodiments, the gasket can be formed of a resilient rubber or plastic material.

As further shown in FIGS. 1 and 2, a freezer door 130 is arranged below refrigerator doors 126, 128 for selectively accessing freezer chamber 124 (FIG. 1). Although freezer door 130 is configured as a pull out door in FIG. 1, in other exemplary embodiments, refrigerator appliance 100 can include one or more freezer doors that are rotatably hinged or mounted to housing 102 in the same or similar fashion as refrigerator doors 126, 128. Such rotatably hinged freezer doors can likewise include respective hinge assemblies 200. Exemplary embodiments of hinge assembly 200 will be described below.

Figure 3:
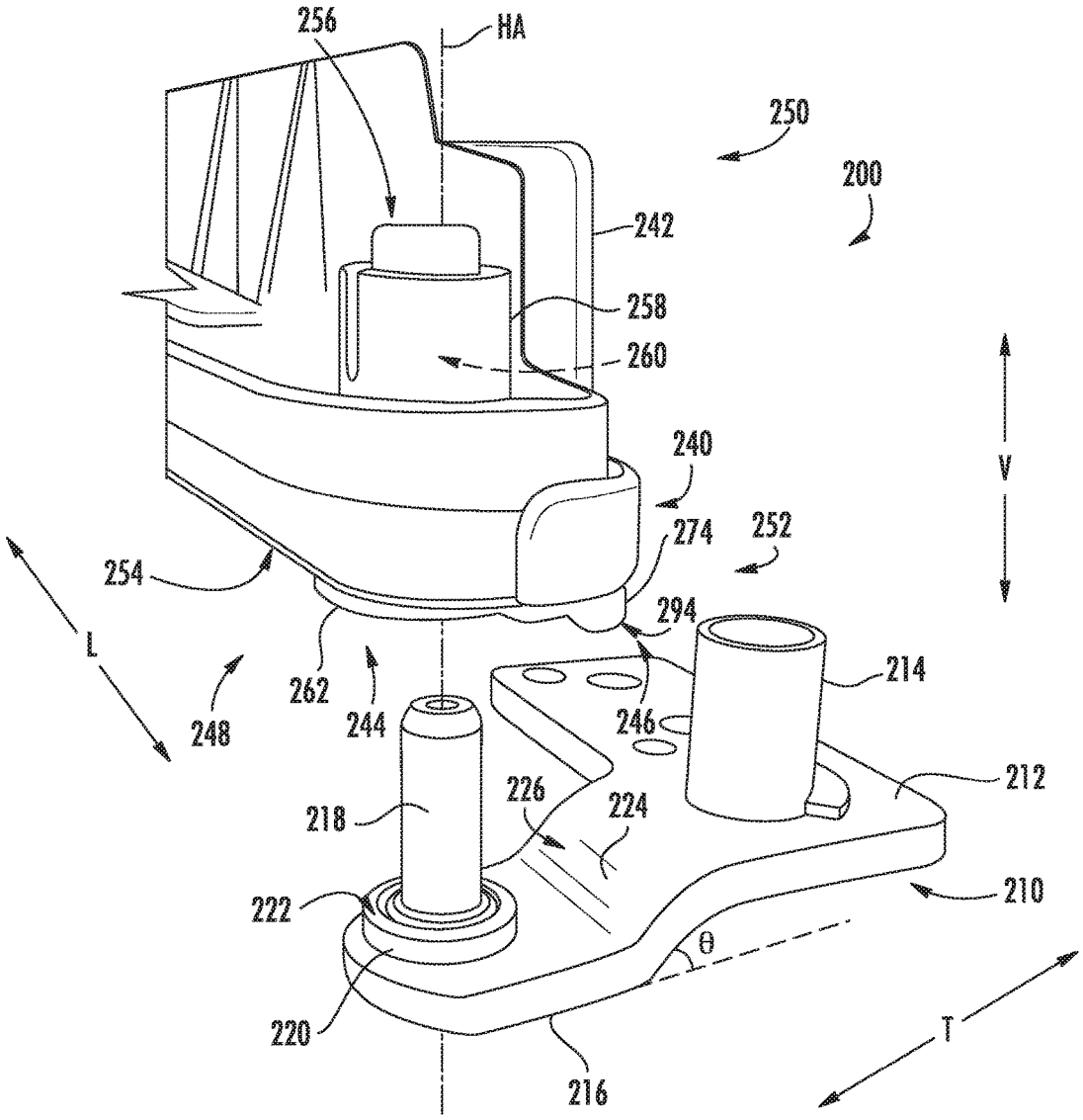
FIG. 3 provides an exploded view of an exemplary hinge assembly for one of the refrigerator doors of the refrigerator appliance of FIGS. 1 and 2.

FIG. 3 provides an exploded view of one of the door hinge assemblies 200 of refrigerator appliance 100 of FIGS. 1 and 2. Hinge assembly 200 can be used to rotatably couple: inner door 132 with housing 120, outer door 134 with inner door 132, or refrigerator door 126 to housing 120, a combination of the foregoing, etc. In FIG. 3, portions of refrigerator appliance 100 have been removed for additional clarity.

As shown, hinge assembly 200 includes a hinge bracket 210. Hinge bracket 210 can be coupled with the housing 120. Hinge bracket 210 can be directly coupled to housing 120 or can be indirectly coupled with housing 120. More particularly, hinge bracket 210 includes an attachment plate 212 that attaches to some component (not shown in FIG. 3 for additional clarity) of refrigerator appliance 100. For example, attachment plate 212 can be directly connected or attached to housing 120 of refrigerator appliance 100 (FIGS. 1 and 2). As another example, attachment plate 212 can be connected to inner door 132 of refrigerator appliance 100 (FIGS. 1 and 2), and thus, hinge bracket 210 can be indirectly coupled with housing 120 and directly connected to inner door 132.

For this embodiment, attachment plate 212 is generally rectangular with rounded edges and extends in a plane along the lateral and transverse directions L, T (i.e., in a plane perpendicular to the vertical direction V). Attachment plate 212 has a thickness along the vertical direction V. Attachment plate 212 defines various apertures for receiving one or more fasteners to secure hinge bracket 210 to a component of refrigerator appliance 100. Attachment plate 212 also includes a bushing 214 extending from attachment plate 212 along the vertical direction V. Bushing 214 further secures hinge bracket 210 with some component of refrigerator appliance 100.

Hinge bracket 210 also includes a pin plate 216 spaced apart from attachment plate 212 along the transverse direction T and the vertical direction V. Pin plate 216 generally extends in a plane along the lateral and transverse directions L, T (i.e., in a plane perpendicular to the vertical direction V) and has a thickness along the vertical direction V. Accordingly, pin plate 216 extends in a plane substantially parallel or parallel to attachment plate 212. A pivot pin 218 extends from pin plate 216 in the vertical direction V. For this embodiment, pivot pin 218 extends from pin plate 216 upward along the vertical direction V (i.e., toward top 101 of refrigerator appliance 100 as shown in FIG. 1). Pivot pin 218 defines a hinge axis HA, which for this embodiment is an axis extending along the vertical direction V. A flange 220 is disposed about the base of pivot pin 218 to secure pivot pin 218 with pin plate 216. Moreover, as will be explained more fully below, flange 220 provides a mating surface 222 on which a component of a cam assembly can rest or seat during various phases of a swing arc of a door.

An extension portion 224 of hinge bracket 210 extends between and connects attachment plate 212 and pin plate 216. In particular, extension portion 224 extends along the transverse direction T between attachment plate 212 and pin plate 216. Notably, extension portion 224 includes a ramped surface 226. For this embodiment, the ramped surface 226 slopes or inclines downward along the vertical direction as extension portion 224 extends from attachment plate 212 to pin plate 216 along the transverse direction T. Accordingly, pin plate 216 is spaced apart from attachment plate 212 along the vertical direction V and pin plate 216 is positioned vertically below attachment plate 212. Moreover, pin plate 216 is spaced apart from attachment plate 212 along the transverse direction T by extension portion 224. Extension portion 224 has a width along the lateral direction L, a length along the transverse direction T, and a thickness along the vertical direction V.

For this embodiment, the ramped surface 226 has an angle of inclination θ of forty-five degrees (45°) with respect to the transverse direction T. Thus, in some embodiment, the angle of inclination θ of ramped surface 226 can be about forty-five degrees (45°). In some embodiments, the angle of inclination θ of ramped surface 226 can be between about thirty degrees (30°) and about sixty degrees (60°). More preferably, in yet other embodiments, the angle of inclination θ of ramped surface 226 can be between about forty degrees (40°) and about fifty degrees (50°). In this context, "about" is to be understood as including within ten percent greater or less than the stated angle. The angle of inclination θ of ramped surface 226 can be other suitable angles as well, such as e.g., one or more angles not specifically noted above.

As will be explained more fully below, as the door is rotated or pivoted along its swing arc, a cam projection contacts or engages ramped surface 226 during certain phases of the swing arc such that the door is raised or lowered along the vertical direction V. In this way, opening or closing of the door is facilitated. Ramped surfaces with larger angles of inclination require a greater amount of force to open or close the door and may also cause the door to rise and lower too quickly. Ramped surfaces with smaller angles provide less of a door rise but make it easier to open and close the door. By selecting the angle of inclination θ of ramped surface 226 within one of the ranges of angles noted above, the desired "rise" of the door is balanced with the door opening force. That is, the force to open the door is not too great and the rise of the door is still sufficient to facilitate opening and closing of the door.

Referring still to FIG. 3, hinge assembly 200 also includes a cam assembly 240. Cam assembly 240 can be integrally formed with or coupled to a door of an appliance, such as e.g., refrigerator door 126, inner door 132, outer door 134, etc. of refrigerator appliance 100 of FIGS. 1 and 2. For instance, for this embodiment, cam assembly 240 is coupled with an end cap 242 of a door (the door has been removed in FIG. 3 for additional clarity). End cap 242 can be formed of a plastic or other suitable materials, for example, and can be integrally formed with or connected with a door at the top or bottom (or both) of the door. Moreover, end cap 242 extends between a front 244 and a back 246 along the transverse direction T, between a first end (not shown) and a second end 248 along the lateral direction L, and a top 250 and a bottom 252 along the vertical direction V.

A thimble 256 extends from end cap 242 and is configured and arranged to receive pivot pin 218 when the door is rotatably coupled to housing 120. In some embodiments, thimble 256 can extend from a cam plate of cam assembly 240. Thimble 256 includes a generally cylindrical housing 258 that extends along the vertical direction V, and more particularly, housing 258 of thimble 256 extends along the hinge axis HA. Housing 258 defines an interior volume 260 in which pivot pin 218 is received. When the door is rotated or pivoted about the hinge axis HA, thimble 256 rotates about the hinge axis HA relative to pivot pin 218.

Figure 4:
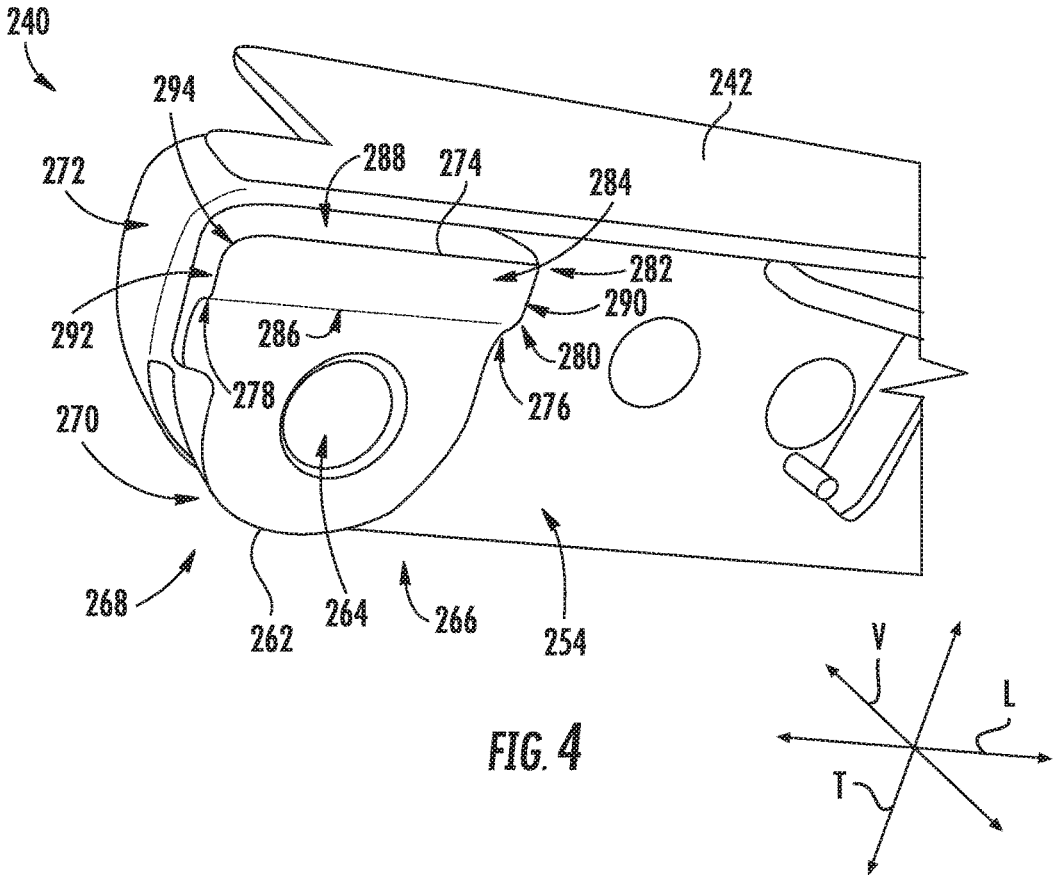
FIG. 4 provides a close up perspective view of an exemplary cam assembly of the hinge assembly of FIG. 3.

FIG. 4 provides a close up perspective view of exemplary cam assembly 240 of the hinge assembly 200 of FIG. 3. As shown, cam assembly 240 includes a cam plate 262. Cam plate 262 can be coupled or integral with outer door 134, another door of an appliance, or to end cap 242. For this embodiment, cam plate 262 is fixedly attached to a bottom surface 254 of end cap 242. End cap 242 is in turn coupled to a door. Cam plate 262 can be fixedly attached to end cap 242 via a suitable method, such as e.g., by mechanical fasteners or a suitable adhesive. In some embodiments, cam plate 262 can be integrally formed with end cap 242 (e.g., cam plate 262 can be molded with end cap 242 or additively layered as a single unitary piece via an additive manufacturing method) or another portion of a door.

Cam plate 262 extends in a plane along the lateral and transverse directions L, T (i.e., in a plane perpendicular to the vertical direction V) and has a thickness in the vertical direction V. Cam plate 262 extends between a first side 266 and a second side 268 along the lateral direction L and between a front 270 and a back 272 along the transverse direction T. The front portion of cam plate 262 proximate front 270 has a generally circular shape. The circular shape of the front portion is shaped complementary to bottom surface 254 of end cap 242 where the front portion of cam plate 262 mates with end cap 242. The back portion of cam plate 262 proximate back 272 has a generally rectangular shape. The rectangular shape of the back portion is shaped complementary to bottom surface 254 of end cap 242 where the back portion of cam plate 262 mates with end cap 242. Further, cam plate 262 defines an opening 264 (FIG. 4) that is sized so that pivot pin 218 can be readily received within interior volume 260 of thimble 256 (FIG. 3).

As shown particularly in FIG. 3, a cam projection 274 projects or extends from cam plate 262 in a direction opposite thimble 256. As shown in FIG. 4, for this embodiment, cam projection 274 projects from cam plate 262 in a generally rectangular shape. Cam projection 274 has a height along the vertical direction V, a length along the lateral direction L, and a width along the transverse direction T. For this embodiment, the length of cam projection 274 extends along the entire length of the back 272 of cam plate 262. In other embodiments, however, the length of cam projection 274 need not extend along the entire back 272 of cam plate 262. Although cam projection 274 is shown projecting from cam plate 262, in some embodiments, cam projection 274 can project or extend from bottom surface 254 of end cap 242 or from another portion of the door.

Cam projection 274 extends between a first end 276 and a second end 278 along the lateral direction L to define the length of cam projection 274. Cam projection 274 also extends between a front 280 and a back 282 along the transverse direction T to define the width of cam projection 274. A bottom surface 284 and side surfaces of cam projection 274 define the generally rectangular shape of the projection. Cam projection 274 includes a front side surface 286, a back side surface 288 spaced from front side surface 286, a first side surface 290 connecting the front and back side surfaces 286, 288 at first end 276 of cam projection 274, and a second side surface 292 connecting the front and back side surfaces 286, 288 at second end 278 of cam projection 274.

Moreover, for this embodiment, the edge where the second side surface 292 connects with the back side surface 288 is a rounded edge. In addition, the edge where the second side surface 292 connects with the bottom surface 284 and the edge where the back side surface 288 connects with the bottom surface 284 both are rounded edges or surfaces. The junction where the second side surface 292, back side surface 288, and bottom surface 284 of cam projection intersect may be deemed the contact edge 294 of cam projection 274, which is a rounded edge of cam projection 274 in the depicted embodiment of FIG. 4. In some alternative embodiments, bottom surface 284 and at least one of the side surfaces 286, 288, 290, 292 define contact edge 294. In such embodiments, contact edge 294 has a rounded surface or edge.

Contact edge 294 of cam projection 274 is configured to engage ramped surface 226 of hinge bracket 210 through at least a portion of the swing arc of the door. By engaging ramped surface 226 of hinge bracket 210, hinge assembly 200 can raise the door a greater vertical height than the height of cam projection 274. In this way, the vertical span of hinge assembly 200 can be minimized while still providing a satisfactory door rise as the door is rotated through its swing arc. Moreover, by offsetting cam projection 274 from the hinge axis HA (i.e., spacing the cam projection 274 from the hinge axis HA), contact edge 294 is allowed to engage ramped surface 226 through a greater range of angular positions of the swing arc of the door. In this way, the door can rise and lower more smoothly as it is opened or closed, and additionally, the door can be opened or closed with less force.

Figure 5:
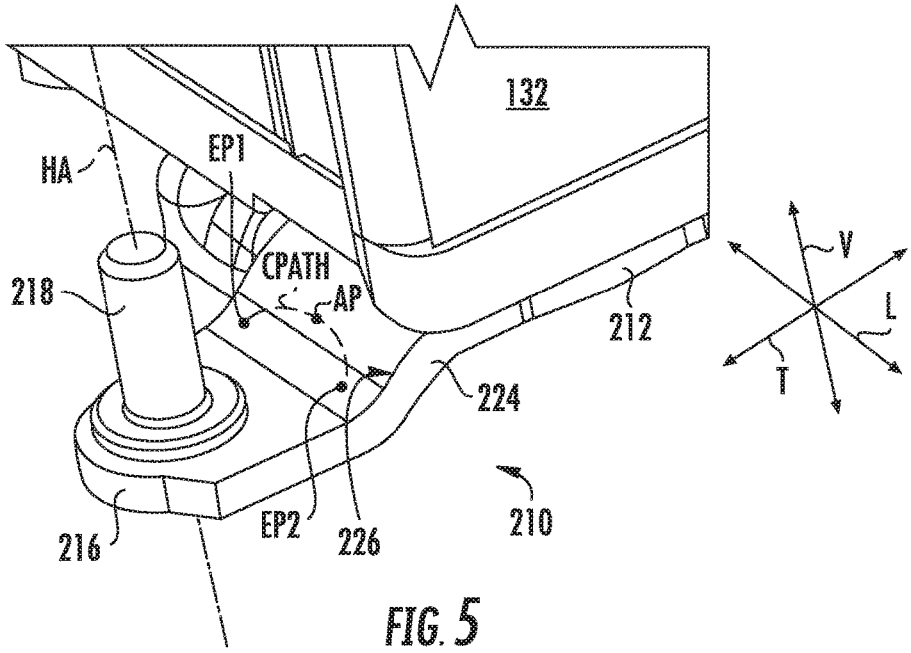
FIG. 5 provides a close up perspective view of an exemplary hinge bracket of the hinge assembly of FIG. 3.

FIG. 5 provides a perspective view of hinge bracket 210 of hinge assembly 200 coupled to inner door 132 with outer door 134 and cam assembly 240 removed for additional clarity. For this embodiment, as outer door 134 (not shown) is rotated or pivoted about hinge axis HA, contact edge 294 of cam projection 274 (FIGS. 3 and 4) engages ramped surface 226 of hinge bracket 210 through at least a portion of the swing arc of outer door 134. In particular, as shown in FIG. 5, contact edge 294 engages or contacts ramped surface 226 continuously along a contact path $C_{PATH}$ such that outer door 134 can be raised or lowered along the vertical direction V as outer door 134 is swung through its swing arc. In this way, ramped surface 226 defines the contact path $C_{PATH}$. The contact path $C_{PATH}$ is indicative of where cam projection 274 engages the ramped surface 226 as the door is rotated through the swing arc. As shown for this embodiment, the contact path $C_{PATH}$ is a generally arcuate path.

The highest point along the contact path $C_{PATH}$ is denoted as the apex point AP. When cam projection 274 is engaged with ramped surface 226 at the apex point AP, outer door 134 is at its apex position, or greatest vertical height along the swing arc of the door. As further shown in FIG. 5, a first end point EP1 and a second end point EP2 of the contact path $C_{PATH}$ are both positioned vertically below the apex point AP of the contact path $C_{PATH}$ at opposite ends of the contact path $C_{PATH}$. In this manner, the apex point AP is defined between the first and second end points EP1, EP2 and the apex point AP is disposed above both the first and second endpoints EP1, EP2 along the vertical direction V. Moreover, for this embodiment, the first and second end points EP1, EP2 are positioned in substantially the same plane that is perpendicular to the vertical direction V and the first and second end points EP1, EP2 are the lowest vertical points along the vertical direction V of the contact path $C_{PATH}$.

Depending on the direction of rotation of outer door 134 about hinge axis HA, contact edge 294 of cam projection 274 (not shown in FIG. 5) can engage and/or disengage ramped surface 226 at first end point EP1 and/or engage and/or disengage ramped surface 226 at second end point EP2. For instance, if outer door 134 is positioned in a closed position (0°) and swung or rotated about hinge axis HA to a fully open position, contact edge 294 first engages ramped surface 226 at second end point EP2. Contact edge 294 then continues to engage ramped surface 226 along contact path $C_{PATH}$, and as outer door 134 is swung open from the second end point EP2 to the apex point AP, outer door 134 is raised along the vertical direction V. After summiting at the apex position AP, contact edge 294 continues to engage ramped surface 226 along the contact path $C_{PATH}$ as it moves toward the first end point EP1. As outer door 134 is swung open from the apex point AP to the first end point EP1, outer door 134 lowers along the vertical direction V. The momentum built up by the gradual lowering of outer door 134 as it is swung open facilitates opening of the door. At the first end point EP1, contact edge 294 disengages ramped surface 226 and outer door 132 continues to swing toward the fully open position. To close outer door 134 from a fully open position (such as e.g., 125°), contact edge 294 engages ramped surface 226 as noted above but in the reverse direction. The engagement of contact surface 294 of cam projection 274 with ramped surface 226 will be described in greater detail below.

Figure 6:
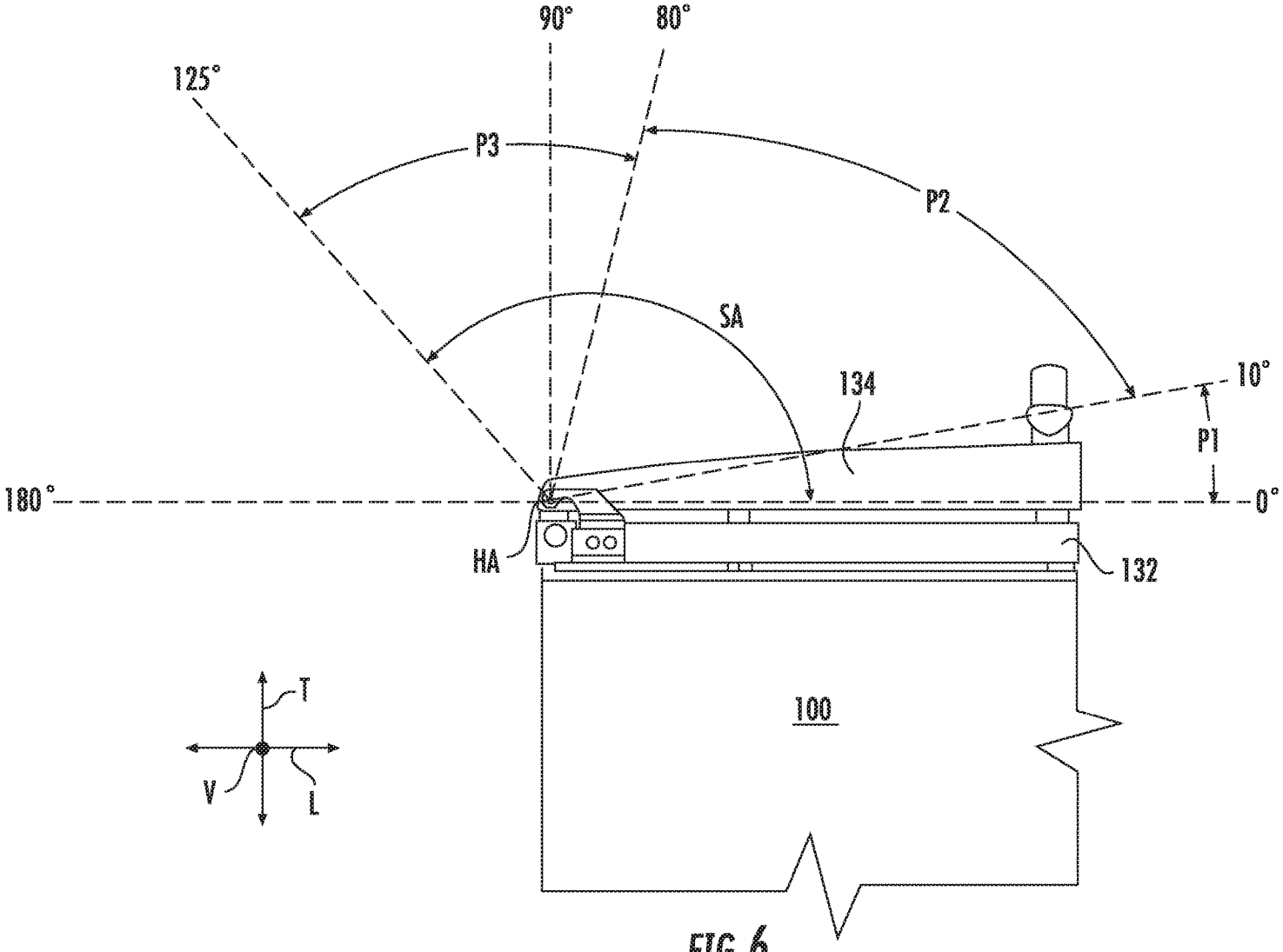
FIG. 6 provides a top plan view of an exemplary swing arc of one of the doors of the refrigerator appliance of FIGS. 1 and 2.

FIG. 6 provides a top plan view of a swing arc SA of outer door 134 of refrigerator appliance 100 of FIGS. 1 and 2. In FIG. 6, outer door 134 and inner door 132 are both shown in the closed position (i.e., at zero degrees (0°)). As shown, outer door 134 is rotatable or movable about hinge axis HA through swing arc SA. Swing arc SA defines a plurality of phases or ranges of angular positions with respect to hinge axis HA. For instance, for this embodiment, swing arc SA defines a first phase P1 that extends between zero degrees (0°) (i.e., the closed position) and ten degrees (10°). Swing arc SA further defines a second phase P2 that extends between about ten degrees (10°) and about eighty degrees (80°). In addition, swing arc SA defines a third phase P3 that extends between about eighty degrees (80°) and the fully open position, which can be any suitable angle. For instance, for this embodiment, the fully open position corresponds to an angular position of one hundred twenty-five degrees (125°). As another example, the fully open position can correspond to an angular position of one hundred forty-five degrees (145°).

Figure 7:
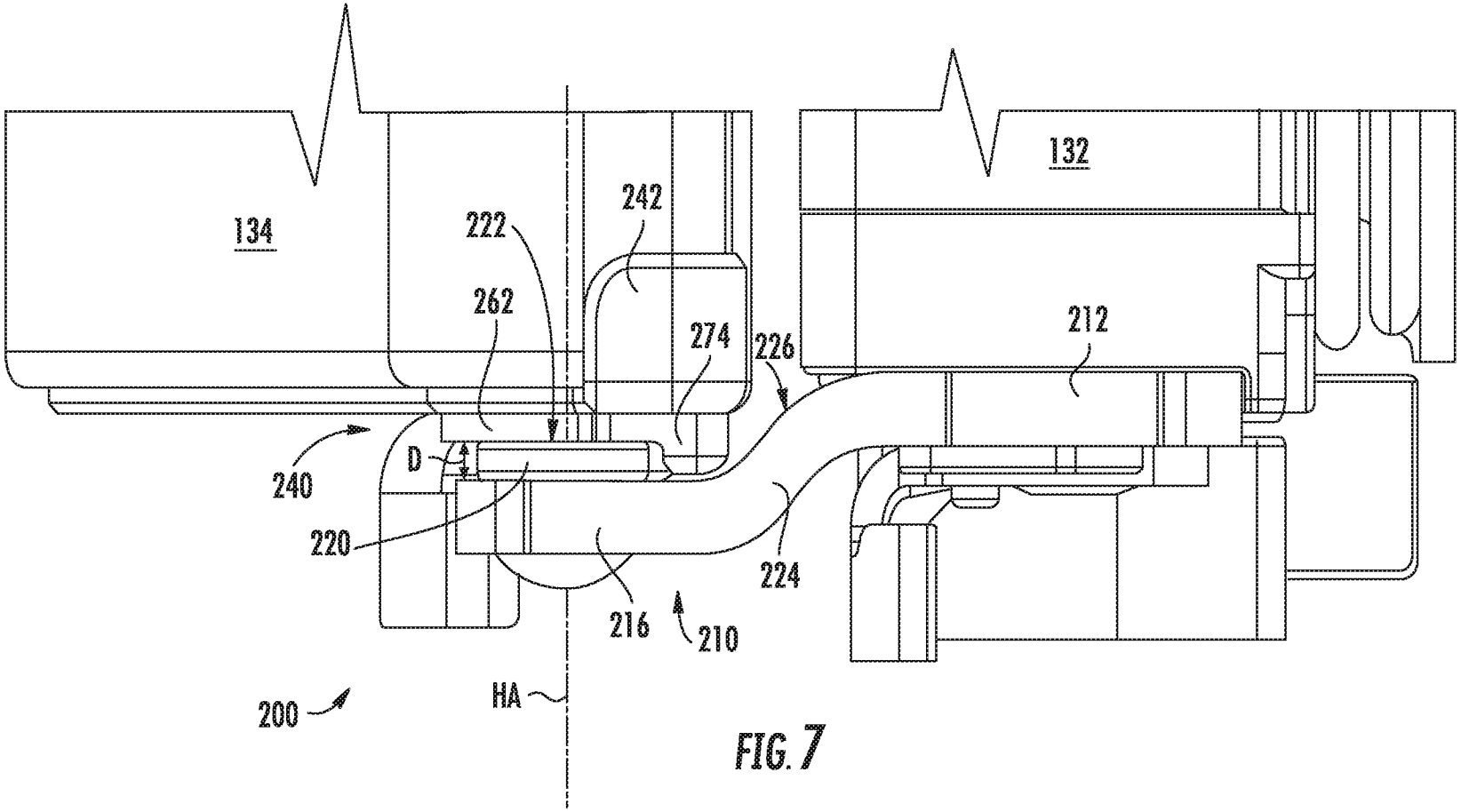
FIG. 7 provides a side view of the hinge assembly of FIG. 3 with the refrigerator door in the closed position.

FIG. 7 provides a side view of hinge assembly 200 that rotatably couples outer door 134 with inner door 132 of refrigerator door 128 of the refrigerator appliance 100 of FIGS. 1 and 2. In FIG. 7, inner door 132 and outer door 134 are both shown in the closed position. Thus, outer door 134 is shown in the first phase P1 of swing arc SA (FIG. 6). When outer door 134 is in the closed position, or at an angular position of zero degrees (0°), cam projection 274 is not engaged with ramped surface 226 of hinge bracket 210 as shown in FIG. 7. Thus, a gap is defined between cam projection 274 and ramped surface 226 while outer door 134 is in the closed position. Moreover, when outer door 143 is in the closed position, cam plate 262 rests or is seated on flange 220 disposed about the base of pivot pin 218 (pivot pin 218 is not visible in FIG. 7). More particularly, the bottom surface of cam plate 262 is depicted contacting or seated on mating surface 222 of flange 220. A distance D is defined between pin plate 216 of hinge bracket 210 and cam plate 262. The distance D corresponds to the vertical elevation or height of outer door 134 (i.e., its rise). By controlling distance D, hinge assembly 200 can facilitate opening and/or closing of outer door 134.

Figure 8:
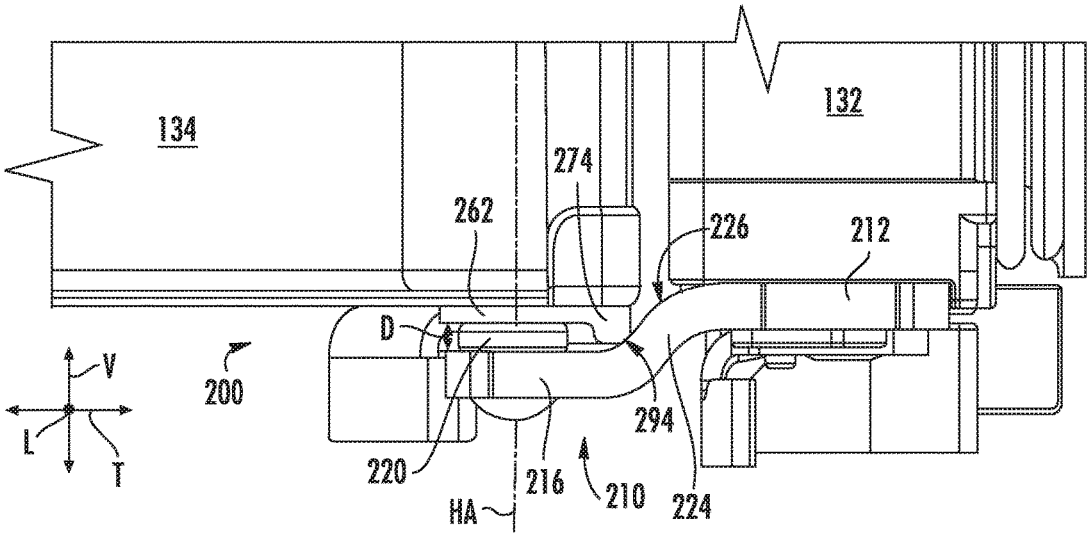
FIG. 8 provides a side view of the hinge assembly of FIG. 3 with the door in an open position and depicting a cam projection engaging a ramped surface of a hinge bracket.

FIG. 8 provides a side view of the hinge assembly 200 of FIG. 7 depicting outer door 134 in an open position. More particularly, in FIG. 8, outer door 134 is shown transitioning from the first phase P1 to the second phase P2 of the swing arc SA of outer door 134 (FIG. 6). Accordingly, for this embodiment, outer door 134 is positioned at about ten degrees (10°). As shown in FIG. 8, contact edge 294 of cam projection 274 engages ramped surface 226 of hinge bracket 210 at the angular position of ten degrees (10°). In particular, contact edge 294 engages ramped surface 226 at the second end point EP2 of the contact path $C_{PATH}$ (FIG. 5). As outer door 134 is rotated or swung about the hinge axis HA in a direction toward the fully open position and cam projection 274 engages ramped surface 226, outer door 134 begins to rise or move upward along the vertical direction V. As further shown in FIG. 8, when outer door 134 has an angular position of ten degrees (10°), the distance D defined between pin plate 216 and cam plate 262 is slightly greater than the distance between pin plate 216 and cam plate 262 when outer door 134 is in the closed position as shown in FIG. 7. Accordingly, outer door 134 has been moved along the vertical direction V, and more particularly, outer door 134 has risen along the vertical direction V.

Figure 9:
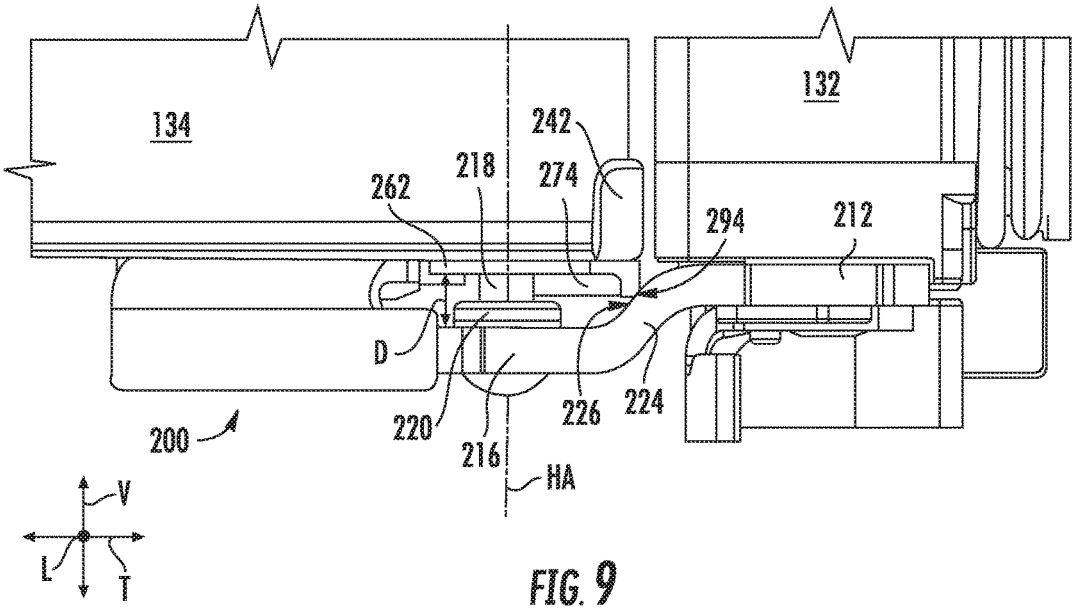
FIG. 9 provides a side view of the hinge assembly of FIG. 3 with the door in an open position and raised to an apex position along the swing arc of the door.

FIG. 9 provides a side view of the hinge assembly 200 of FIG. 7 with outer door 134 in an open position and raised along the vertical direction V to an apex position. Accordingly, for this embodiment, outer door 134 is positioned at an angular position of about fifty degrees (50°). Thus, outer door 134 is positioned within the second phase P2 of the swing arc SA (FIG. 6). At the depicted angular position, outer door 134 is positioned at its apex position (i.e., at its greatest vertical height or rise), as noted above. In the apex position, the distance D defined between pin plate 216 and cam plate 262 is at its greatest distance. As such, pin 218 is visible in FIG. 9. As further shown in FIG. 9, contact edge 294 has moved upward along the ramped surface 226 to the apex point AP (FIG. 5) along the contact path $C_{PATH}$. For this embodiment, when in the apex position, outer door 134 has moved along the vertical direction V (i.e., risen) about 0.15 inches (≈0.38 cm).

Figure 10:
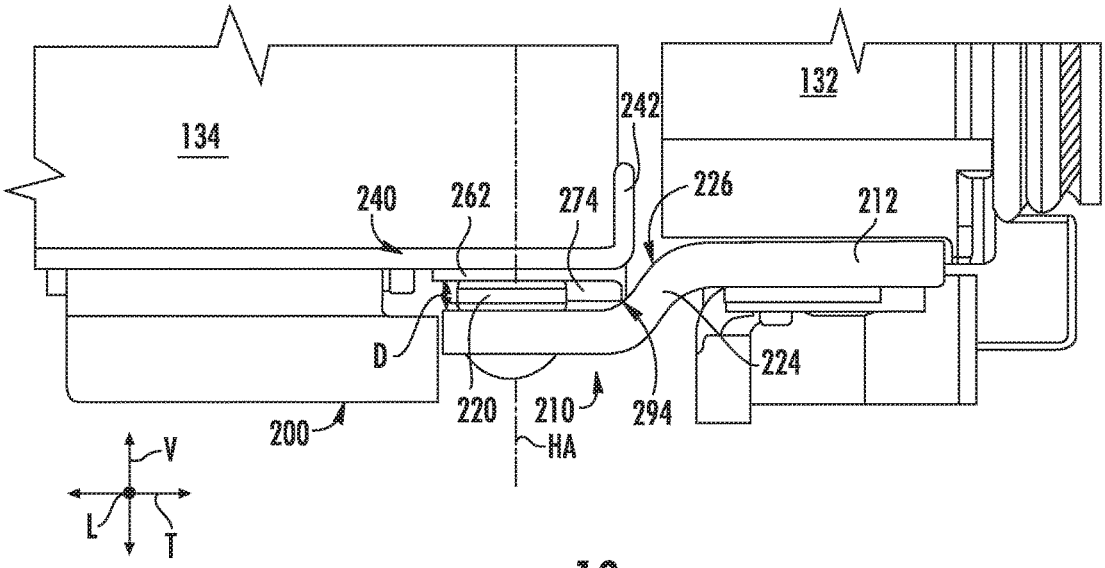
FIG. 10 provides a side view of the hinge assembly of FIG. 3 with the door in an open position and depicting the cam projection still engaging the ramped surface of the hinge bracket.

FIG. 10 provides a side view of the hinge assembly 200 of FIG. 7 depicting outer door 134 in an open position. More particularly, in FIG. 10, outer door 134 is shown transitioning from the second phase P2 to the third phase P3 of the swing arc SA of outer door 134 (FIG. 6). Accordingly, for this embodiment, outer door 134 is positioned at about eighty degrees (80°) and contact edge 294 is still engaged with ramped surface 226. More particularly, contact edge 294 is engaged with ramped surface 226 at the first end point EP1 of the contact path $C_{PATH}$ (FIG. 5). For this embodiment, when outer door 134 reaches an angular position of eighty degrees (80°), the distance D defined between pin plate 216 and cam plate 262 returns or reverts to the same distance defined between the pin plate 216 and cam plate 262 when outer door 134 was positioned at an angular position of about ten degrees (10°). When outer door 134 swings from the apex position (i.e., an angular position of about fifty degrees (50°) in this embodiment) toward the fully open position, the lowering of the door along the vertical direction V and the mass of outer door 134 build up momentum to more easily allow a user to swing the door open.

Figure 11:
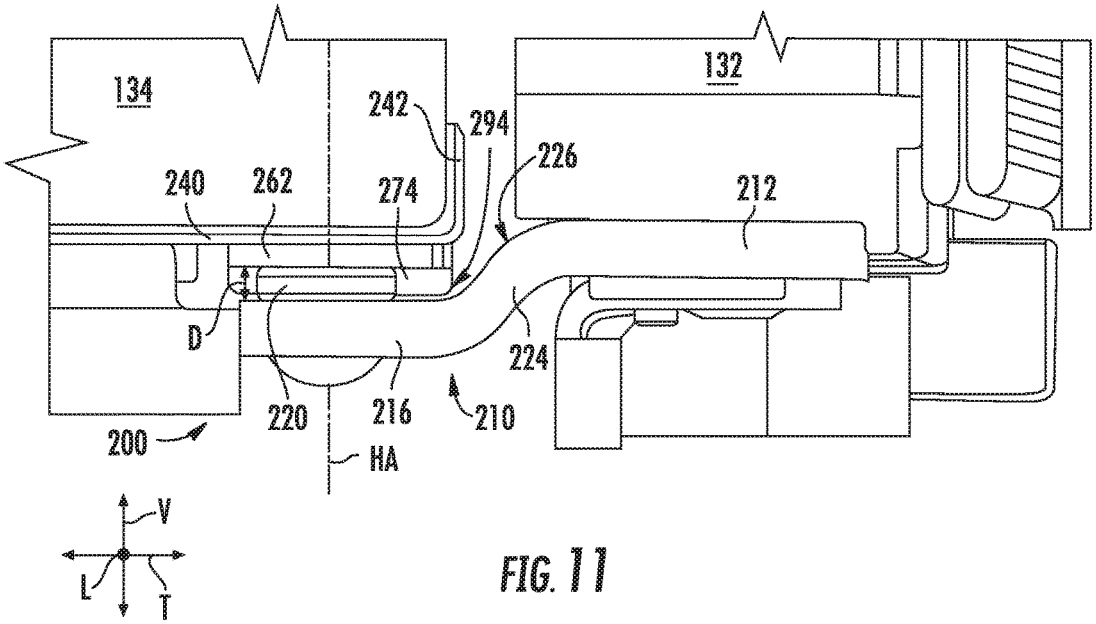
FIG. 11 provides a side view of the hinge assembly of FIG. 3 with the door in an open position and depicting the cam projection disengaged from the ramped surface of the hinge bracket.

FIG. 11 provides a side view of the hinge assembly 200 of FIG. 7 depicting outer door 134 in an open position. More particularly, outer door 134 is shown in FIG. 11 fully transitioned to the third phase P3 of the swing arc SA of outer door 134 (FIG. 6). In the third phase P3, as shown in FIG. 11, contact edge 294 is completely disengaged from ramped surface 226. As such, the distance D or rise of outer door 134 has returned to its base height, which in this embodiment is the same height as the height of outer door 134 in the first phase P1 of the swing arc SA. Further, as outer door 134 swings further toward the fully open position, which is an angular position of one hundred twenty-five degrees (125°) in this embodiment, contact edge 294 no longer contacts ramped surface 226.

When swinging or rotating outer door 134 from the fully open position to the closed position, contact edge 294 will contact ramped surface 226 in the same way as described above but in a reverse fashion. That is, when outer door 134 is positioned at about eighty degrees (80°) and being swung toward the closed position, contact edge 294 engages ramped surface 226 at first end point EP1 of contact path $C_{PATH}$. As outer door 134 swings through its swing arc SA, outer door 134 will rise along the vertical direction V until outer door 134 reaches its apex position, or greatest vertical height. For this embodiment, the apex position corresponds with an angular position of fifty degrees (50°). After summiting at the apex position, outer door 134 will begin to lower as it is swung through it swing arc SA toward the closed position. When outer door 134 reaches an angular position of about ten degrees (10°), contact edge 294 disengages ramped surface 226 at second end point EP2 of contact path $C_{PATH}$. When outer door 134 swings from the apex position toward the close position, the lowering of outer door 134 along the vertical direction V and the mass of outer door 134 build up momentum such that closing of outer door 134 is facilitated.

Although hinge assembly 200 illustrated in FIGS. 7 through 11 and described in the accompanying text was described as a hinge assembly for an outer door rotatably coupled with an inner door of a door-in-door refrigerator appliance, it will be appreciated that hinge assembly 200 shown and described herein can be applied to any suitable hinged door for a consumer appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance defining a vertical direction, a lateral direction, and a transverse direction each mutually perpendicular to one another, the appliance comprising:
- a housing;
- a door rotatable through a swing arc;
- a hinge assembly rotatably coupling the door with the housing, the hinge assembly comprising:
  - a hinge bracket coupled with the housing, the hinge bracket comprising:
    - an attachment plate coupling the hinge bracket with the housing;
    - a pin plate extending in a plane perpendicular to the vertical direction;
    - a pivot pin extending from the pin plate along the vertical direction, the pivot pin defining a hinge axis; and
    - an extension portion extending between the attachment plate and the pin plate, the extension portion having a ramped surface;
    - wherein the ramped surface slopes downward along the vertical direction from the attachment plate to the pin plate; and
  - a cam plate coupled or integral with the door, the cam plate having a cam projection projecting therefrom, wherein the cam projection engages the ramped surface as the door is rotated through at least a portion of the swing arc of the door such that the door is moved along the vertical direction.

2. The appliance of claim 1, wherein a cam assembly coupled or integral with the door comprises the cam plate, the cam plate extending in a plane perpendicular to the vertical direction, the cam assembly further comprising:
- a thimble extending from the cam plate along the hinge axis and configured to receive the pivot pin such that the door can rotate about the hinge axis through the swing arc; and
- wherein the cam projection extending from the cam plate extends along the vertical direction opposite the thimble and wherein the cam projection projects from the cam plate offset from the hinge axis.

3. The appliance of claim 1, wherein the cam plate extends in a plane perpendicular to the vertical direction and the cam projection projects from the cam plate along the vertical direction, the cam projection comprising:
- a bottom surface;
- one or more side surfaces connecting the bottom surface of the cam projection with the cam plate, wherein the bottom surface and at least one of the side surfaces define a contact edge, the contact edge having a rounded surface, and wherein when the cam projection engages the ramped surface of the hinge bracket as the door is rotated through at least a portion of the swing arc, the contact edge of the cam projection engages the ramped surface.

4. The appliance of claim 1, wherein the ramped surface of the hinge bracket defines a contact path indicative of where the cam projection engages the ramped surface as the door is rotated through the swing arc, wherein the contact path has an arcuate shape.

5. The appliance of claim 4, wherein the cam projection engages the ramped surface at a first end point of the contact path and the cam projection disengages the ramped surface at a second end point of the contact path, an apex point being defined between the first and second end points along the contact path, the apex point disposed above both the first and second endpoints along the vertical direction, and wherein the apex point is the highest point along the vertical direction of the contact path, and wherein the first and second end points are positioned in substantially the same plane perpendicular to the vertical direction and the first and second end points are the lowest vertical points along the vertical direction of the contact path.

6. The appliance of claim 1, wherein the ramped surface has an angle of inclination with respect to the transverse direction between about forty degrees (40°) and about fifty degrees (50°).

7. The appliance of claim 1, wherein the ramped surface has an angle of inclination with respect to the transverse direction of about forty-five degrees (45°).

8. The appliance of claim 1, wherein the hinge bracket is directly coupled with the housing.

9. The appliance of claim 1, wherein the appliance is a refrigerator appliance.

10. The appliance of claim 9, wherein the door is an outer door of a door-in-door configuration of the refrigeration appliance, and wherein the hinge bracket is indirectly coupled with the housing and directly coupled with an inner door.

11. The appliance of claim 1, wherein the swing arc of the door extends between a closed position and a fully open position, and wherein the swing arc defines a plurality of phases indicative of a range of angular positions of the door along the swing arc, wherein the plurality of phases comprises a first phase, a second phase, and a third phase, and wherein the first phase extends between the closed position at an angular position of zero degrees (0°) to about ten degrees (10°), the second phase extends between an angular position of ten degrees (10°) to an angular position of about eighty degrees (80°), and the third phase extends between an angular position of about eighty degrees (80°) to the fully open position, and wherein the cam projection engages the ramped surface during the second phase of the swing arc and is disengaged from the ramped surface during the first and third phases of the swing arc.

12. The appliance of claim 1, wherein the door is positioned at an apex position at an angular position of about fifty degrees (50°), wherein the apex position is descriptive of the greatest vertical height of the door.

13. A hinge assembly for a door of an appliance defining a vertical direction, a lateral direction, and a transverse direction and comprising a housing, the door rotatably coupled with the housing by the hinge assembly, the door rotatable through a swing arc, the hinge assembly comprising:

- a hinge bracket coupled with the housing, the hinge bracket comprising:
- a ramped surface extending outward from the housing and sloped in the vertical direction as the ramped surface extends outward from the housing;
- a pin plate connected to the ramped surface of the hinge bracket; and
- a pivot pin extending from the pin plate and defining a hinge axis; and
- a cam assembly coupled or integral with the door, the cam assembly comprising:
  - a cam plate;
  - a thimble extending from the cam plate along the hinge axis and configured to receive the pivot pin;
  - a cam projection projecting from the cam plate, wherein the cam projection engages the ramped surface as the door is rotated through at least a portion of the swing arc of the door such that the door is moved along the vertical direction.

14. The hinge assembly of claim 13, wherein the ramped surface slopes downward along the vertical direction as the ramped surface extends outward from the housing.

15. The hinge assembly of claim 13, wherein the cam plate extends in a plane perpendicular to the vertical direction and the cam projection projects from the cam plate along the vertical direction, the cam projection comprising:

- a bottom surface;
- one or more side surfaces connecting the bottom surface of the cam projection with the cam plate, wherein the bottom surface and at least two of the side surfaces define a contact edge, the contact edge having a rounded surface at the junction of the bottom surface and the at least two side surfaces, and wherein when the cam projection engages the ramped surface of the hinge bracket as the door is rotated through at least a portion of the swing arc, the contact edge of the cam projection engages the ramped surface.

16. The hinge assembly of claim 13, wherein the cam projection projects from the cam plate offset from the hinge axis.

17. The hinge assembly of claim 13, wherein the ramped surface extends outward from the appliance along the transverse direction, and wherein ramped surface has an angle of inclination with respect to the transverse direction of about forty-five degrees (45°).

18. A refrigerator appliance defining a vertical direction, a lateral direction, and a transverse direction each mutually perpendicular to one another, the refrigerator appliance comprising:

- a housing;
- a door rotatable through a swing arc;
- a hinge assembly rotatably coupling the door with the housing, the hinge assembly comprising:
  - a hinge bracket coupled with the housing, the hinge bracket comprising:
  - a ramped surface extending outward from the housing and sloped in the vertical direction as the ramped surface extends outward from the housing;
  - a pin plate connected to the ramped surface of the hinge bracket; and
  - a pivot pin extending from the pin plate and defining a hinge axis; and
  - a cam assembly coupled or integral with the door, the cam assembly comprising:
    - a cam plate;
    - a thimble extending from the cam plate along the hinge axis and configured to receive the pivot pin; and
    - a cam projection projecting from the cam plate, wherein the cam projection engages the ramped surface as the door is rotated through at least a portion of the swing arc of the door such that the door is moved along the vertical direction.

19. The refrigerator appliance of claim 18, wherein the cam plate extends in a plane perpendicular to the vertical direction, and wherein the cam projection projecting from the cam plate extends along the vertical direction opposite the thimble, and wherein the cam projection projects from the cam plate offset from the hinge axis.

20. The refrigerator appliance of claim 18, wherein the ramped surface slopes downward along the vertical direction as the ramped surface extends outward from the housing.

* * * * *